United States Patent [19]

Swarovski

[11] Patent Number: 4,884,257

[45] Date of Patent: Nov. 28, 1989

[54] WRIST WATCH

[75] Inventor: Helmut Swarovski, Wattens, Austria

[73] Assignee: D. Swarovski & Co., Wattens, Austria

[21] Appl. No.: 324,734

[22] Filed: Mar. 17, 1989

[30] Foreign Application Priority Data

Mar. 24, 1988 [DE] Fed. Rep. of Germany ..... 3810001

[51] Int. Cl.[4] ..... G04B 37/00

[52] U.S. Cl. ..... 368/276; 368/280

[58] Field of Search ..... 368/276, 280, 285, 309

[56] References Cited

U.S. PATENT DOCUMENTS

| | | | |
|---|---|---|---|
| 249,862 | 11/1987 | Welch | 368/280 |
| 255,355 | 3/1982 | Triplett | 368/280 |
| 265,300 | 10/1982 | Atterbury | 368/280 |
| 1,740,426 | 12/1929 | Kislinger | 368/280 |
| 3,327,429 | 4/1982 | Klingenberg | 368/294 |
| 3,719,038 | 3/1973 | Klingenberg | 368/276 |
| 3,729,924 | 5/1973 | Aoki | 368/285 |
| 3,931,704 | 1/1976 | Tominaga et al. | 368/280 |
| 4,692,033 | 9/1987 | Mock et al. | 368/280 |

FOREIGN PATENT DOCUMENTS

| | | |
|---|---|---|
| 1952393 | 3/1968 | Fed. Rep. of Germany . |
| 1990596 | 8/1968 | Fed. Rep. of Germany . |
| 2848525 | 11/1978 | Fed. Rep. of Germany . |
| 8706125 | 6/1987 | Fed. Rep. of Germany . |

*Primary Examiner*—Vit W. Miska

*Attorney, Agent, or Firm*—Bacon & Thomas

[57] ABSTRACT

A wrist watch having a case made of faceted glass and reflecting layers for achieving a special esthetic effect.

3 Claims, 1 Drawing Sheet

WRIST WATCH

The present invention relates to a wrist watch having a case made of faceted glass.

Wrist watches usually has a metal case.

Since a wrist watch must be regarded not merely as a timepiece but also as an ornament and piece of jewelry, there is a need for wrist watches of original design.

French Pat. No. 776675 of 1933 already discloses a watch having a case made of faceted glass, but the glass case of this watch does not reflect incident light well, so that the watch has no esthetic appeal.

The invention is based on the problem of providing a wrist watch that has an esthetic effect distinguishing it from all known wrist watches.

The subject of the invention is a wrist watch having a case made of faceted glass that has a recess for taking up a watchwork, which is characterized in that the recess is provided on the top of the case made of faceted glass, the underside of the case and the walls and floor of the recess bear reflecting layers so as to reflect rays of light incident upon the top, and the case is disposed in a bottom portion connected therewith.

The watch case is preferably made of faceted lead crystal. The shape of the glass case can basically be selected as one pleases, and is preferably circular, oval or polygonal, such as rectangular or octagonal, when regarded from above.

The glass may be colored or vaporized to achieve special esthetic effects.

The faceting of the glass case may be obtained in a great variety of ways, the faceting depending both on the geometry of the watch and on the laws of reflection of light.

On the top, the glass case should form a sufficient edge around the watchwork to ensure that the brilliant effect of the faceted glass shows to advantage. The glass case is preferably cut optically.

On the top the glass case has a recess for taking up a watchwork. The recess can be designed in such a way that the watchwork can easily be removed but is nevertheless held tightly enough.

The watchwork itself can be a customary watchwork of any shape, being in particular circular, oval or octagonal.

The time can be set mechanically or electronically. An embodiment is preferred in which pressure on a switch starts a synchronous motor that changes the position of the hands. The switch is preferably located on the bottom of the watchwork or on the bottom of the recess, and is activated by pressure on the top of the watch, the watchwork being mounted movably in the recess. It is not advantageous for the time to be set by means of the usual winding button provided on the side, since the bore required therefor would be visible through the glass and would also be reflected on the reflecting underside.

The glass case has a reflecting design, so that rays of light incident upon the top are reflected on the underside and pass out through the top again, giving rise to the well-known optical effects of cut glass bodies.

For this purpose, the underside of the glass case is preferably provided with a reflecting layer, such as a similization layer, in particular a silver layer, for example with a thickness of 0.001 mm. This silver layer may bear a protective layer, preferably a vaporized metal protective layer, for example also with a thickness of 0.001 mm.

The bottom portion comprises the underside of the glass case more or less. It is connected with the glass case, which can be achieved by clasping, clamping or gluing. The bottom portion is preferably made of metal, in particular stainless and acidproof steel or precious metal. However, other suitable materials can also be used.

The metal bottom is preferably glued to the glass case. A particularly well-suited adhesive is silicon adhesive, since in a hardened state its elasticity allows it to cushion small blows on the crystal case, on the one hand, and it is in a position to compensate the different coefficients of expansion between the metal bottom and the glass case, on the other hand, so as to avoid the glass case popping out of the metal bottom.

The attachments between the watch and the watch strap are preferably of movable design, so that the strap can conform better to the wrist.

To increase the brilliance, the inside of the recess, both its bottom and its walls, is also provided with a reflecting layer, which can be applied for example by sputtering, or in the same way as the reflecting layer is applied to the underside of the glass case.

The invention shall be explained in more detail below with reference to the drawing showing an exemplary embodiment.

Figure 1:
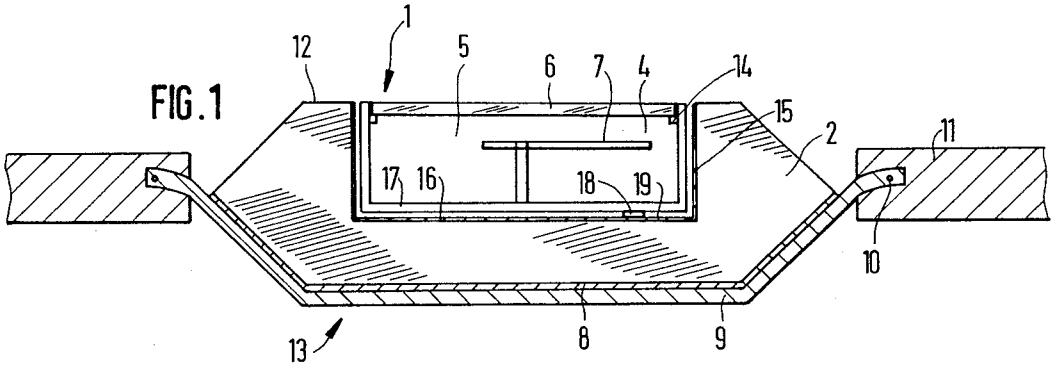
FIG. 1 shows a wrist watch in cross-section.
Figure 2:
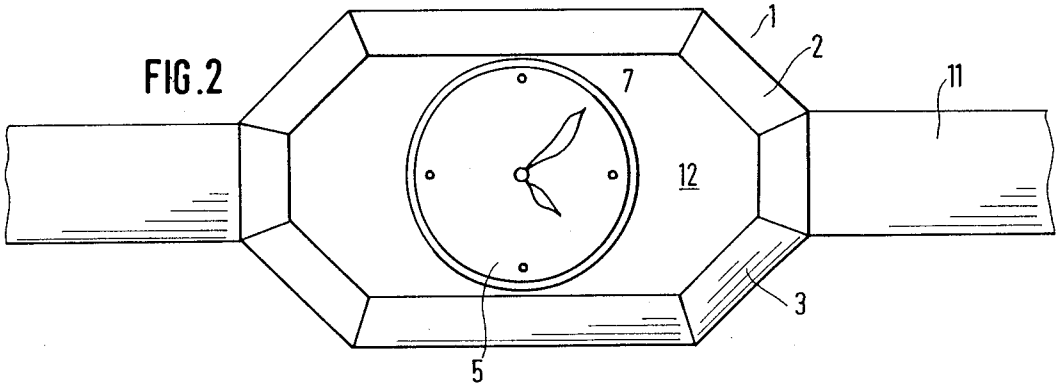
FIG. 2 shows the wristn watch shown in FIG. 1 from the top.

Wrist watch 1 comprises essentially a glass case 2 which has facets 3 for obtaining special optical effects.

On top 12 there is a recess 4 into which a watchwork 5 is inserted in removable fashion. Watchwork 5 comprises a watchwork case 14 with cover glass 6. Hands 7 are indicated while the actual watchwork is not.

On underside 13 there is a reflecting layer 8 for improving the reflection. Walls 15 and bottom 16 of recess 4 are also provided with a reflecting layer 19, in particular a silver layer, for increasing the reflection.

Bottom portion 9 comprises the lower portion of glass case 2 and is connected therewith. Bottom portion 9 has attachment means 10 for watch strap 11.

On bottom 16 of recess 4 or on bottom 17 of watchwork 5, or between the two, there is a switch 18. By activating this switch 18 one starts a synchronous motor (not shown) that changes the position of the hands to set the time. The switch is activated by pressure on the top of the watch, generally the area under which the switch is located. To transmit the pressure on the top of the watch to switch 18, the watchwork is mounted movably, in particular spring-mounted.

The inventive wrist watches are characterized by a special esthetic effect.

I claim:

1. A wrist watch having a case made of faceted glass that has a recess for taking up a watchwork, characterized in that the recess (4) is provided on the top (12) of the case (2) made of faceted glass, the underside (13) of the case (2) and the walls (15) and floor (16) of the recess (4) bear reflecting layers (8, 19) so as to reflect the rays of light incident upon the top (12), and the case (2) is disposed in a bottom portion (9) connected therewith.

2. A wrist watch as in claim 1, characterized in that a switch (18) for setting the time is disposed on the bottom (16) of the recess (4) or on the bottom (17) of the watchwork.

3. A wrist watch as in claim 1, characterized in that the glass case (2) is glued to the bottom portion (9) by means of silicon adhesive.

* * * * *